US008256578B2

(12) United States Patent
Eckersley et al.

(10) Patent No.: US 8,256,578 B2
(45) Date of Patent: Sep. 4, 2012

(54) INDUSTRIAL TRUCK WITH TWO WHEEL ARMS AND METHOD FOR ASSEMBLING THE INDUSTRIAL TRUCK

(75) Inventors: Paul John Eckersley, Hampshire (GB); Barry Michael Warner, Hampshire (GB)

(73) Assignee: Linde Material Handling GmbH, Aschaffenburg (DE)

( * ) Notice: Subject to any disclaimer, the term of this patent is extended or adjusted under 35 U.S.C. 154(b) by 1177 days.

(21) Appl. No.: 11/359,875

(22) Filed: Feb. 22, 2006

(65) Prior Publication Data

US 2006/0214407 A1 Sep. 28, 2006

(30) Foreign Application Priority Data

Feb. 25, 2005 (GB) ..... 0503980.5

(51) Int. Cl.
*B66F 9/06* (2006.01)
*B66F 9/08* (2006.01)

(52) U.S. Cl. ..... 187/226; 187/222; 187/230; 414/631

(58) Field of Classification Search ..... 187/230, 187/232, 237, 238, 222, 225, 226; 301/111.06, 301/125; 414/631, 679, 680; 180/68.5, 21, 180/23, 252, 253; *B66F 9/06, 9/08, 7/28; B60D 11/10; B62D 11/10; B60R 16/04*
See application file for complete search history.

(56) References Cited

U.S. PATENT DOCUMENTS

| | | | | | |
|---|---|---|---|---|---|
| 3,240,372 | A * | 3/1966 | Joyce et al. | 414/631 |
| 3,515,233 | A * | 6/1970 | Stammen | 180/13 |
| 3,616,953 | A * | 11/1971 | Shaffer et al. | 414/631 |
| 3,638,961 | A * | 2/1972 | Larsen | 280/755 |
| 3,876,039 | A * | 4/1975 | Bushnell, Jr. | 187/226 |
| 5,584,363 | A * | 12/1996 | Curtin et al. | 187/243 |
| 6,022,183 | A * | 2/2000 | Walters et al. | 414/607 |
| 6,033,177 | A * | 3/2000 | Kooima | 414/438 |
| 6,138,796 | A * | 10/2000 | Herschel | 187/232 |
| 6,182,778 | B1 * | 2/2001 | Henshaw et al. | 180/89.12 |
| 6,199,665 | B1 * | 3/2001 | Eilerman et al. | 187/232 |
| 6,551,050 | B1 * | 4/2003 | Kallevig et al. | 414/607 |
| D480,858 | S * | 10/2003 | Sellar | D34/34 |
| 2005/0034928 | A1 * | 2/2005 | Lewis et al. | 187/230 |
| 2005/0121241 | A1 * | 6/2005 | Shorney et al. | 180/68.5 |

* cited by examiner

*Primary Examiner* — Michael Mansen
*Assistant Examiner* — Stefan Kruer
(74) *Attorney, Agent, or Firm* — The Webb Law Firm

(57) ABSTRACT

An industrial truck has a vehicle frame (1), a lifting framework (4) attached to the vehicle frame (1) and two wheel arms which extend in the horizontal direction. The wheel arm is connected to the vehicle frame (1) and at the free end of which at least one running wheel (3) is arranged. Each wheel arm has a first longitudinal structural part (2) which is a component of the vehicle frame (1) and has a second longitudinal structural part (5) which is a component of the lifting framework (4). The running wheel (3) is arranged on the first longitudinal structural part (2). A screwed connection is provided for connecting the first longitudinal structural part (2) to the second longitudinal structural part (5)

11 Claims, 2 Drawing Sheets

INDUSTRIAL TRUCK WITH TWO WHEEL ARMS AND METHOD FOR ASSEMBLING THE INDUSTRIAL TRUCK

CROSS REFERENCE TO RELATED APPLICATION

This application claims priority to British Application No. GB 0 503 980.5, filed Feb. 25, 2005, herein incorporated by reference in its entirety.

BACKGROUND OF THE INVENTION

1. Field of the Invention The invention relates to an industrial truck with a vehicle frame, a lifting framework attached to the vehicle frame and two wheel arms which extend in the horizontal direction. The wheel arm is connected to the vehicle frame and at the free end of which at least one running wheel is arranged. The invention also relates to a method for assembling an industrial truck which has a vehicle frame, a lifting framework attached to the vehicle frame and at least one wheel arm which extends in the horizontal direction. The wheel arm is connected to the vehicle frame and at the free end of which at least one running wheel is arranged. Each wheel arm has a first longitudinal structural part which is a component of the vehicle frame, and each wheel arm has a second longitudinal structural part which is a component of the lifting framework.

2. Technical Considerations

Industrial trucks having wheel arms include, for example, reach fork trucks, high-lift trucks, high-bay stackers or high-bay order pickers. The common characteristic feature of these industrial truck types is that the vehicle frame, the lifting framework and the wheel arms are rigidly interconnected and can have common structural parts as well. The vehicle frame bears in particular the drive units and a drive battery for the industrial truck, the vehicle frame standing on the running surface with at least one steerable drive wheel and as a rule with at least one other wheel. A driver's seat for the operator of the industrial truck is frequently also located on the vehicle frame.

The vertically-aligned lifting framework, which as a rule cannot be inclined in industrial trucks of the generic type, is arranged directly adjacent to the vehicle frame. A non-raisable mast of the lifting framework is connected rigidly to the vehicle frame. At least one mast which can be extended in the vertical direction is guided on this non-raisable mast. A load-receiving means is in turn guided movably in the vertical direction on the extendable mast. In the case of reach fork trucks, the load-receiving means can moreover be moved in the horizontal direction relative to the lifting framework.

The wheel arms of the industrial truck extend from the vehicle frame in the horizontal direction under the lifting framework. A running wheel is in each case located at the end of the wheel arms facing away from the vehicle frame. In this connection, the running wheels of the wheel arms are arranged in such a way that, as viewed in the horizontal longitudinal direction of the industrial truck, the lifting framework is located between the vehicle frame and the running wheels. The forces acting on the lifting framework, in particular the dead weight of the lifting framework and, with a corresponding position of the retractable forks, the weight of a raised load, are thus supported on the running surface partly by the running wheels and partly by the wheels arranged on the vehicle frame.

An object of the present invention is to provide an industrial truck of the general kind referred to in the introduction but which is distinguished by a favorable force flow in the region of the connections between the vehicle frame, the lifting framework and the wheel arms, and can be assembled in a more simple way. An object is also to provide a method for assembly of such an industrial truck.

SUMMARY OF THE INVENTION

As far as the industrial truck is concerned, the above-mentioned object is achieved according to the invention by virtue of the fact that each wheel arm has a first longitudinal structural part which is a component of the vehicle frame, and each wheel arm has a second longitudinal structural part which is a component of the lifting framework. The two longitudinal structural parts extend in the longitudinal direction (with respect to the industrial truck) of the wheel arm and constitute an important structural part of the wheel arm in terms of taking up force. The first longitudinal structural part is a component of the vehicle frame. This means that the first longitudinal structural part is already connected firmly to the other structural parts of the vehicle frame during manufacture of the vehicle frame. Ideally, the first longitudinal structural part has at least one element, for example a metal plate, which extends from the region of the wheel arm into the region of the drive unit, of the driver's position, and/or of the battery block. The second longitudinal structural part is a component of the lifting framework. The second longitudinal structural part is then already connected firmly to a non-extendable mast of the lifting framework during manufacture of the lifting framework. There is preferably a welded connection between the second longitudinal structural part and the non-extendable mast, but a screwed connection is also possible.

The first longitudinal structural part is suitably arranged in the region of the outer side of the wheel arm. The first longitudinal structural part is, as defined above, a component of the vehicle frame. In this connection, the expression "outer side" refers to the industrial truck as a whole. If two wheel arms are provided, the first longitudinal structural part of the left wheel arm is, therefore, arranged on its left side, while the first longitudinal structural part of the right wheel arm is arranged on its right side.

Similarly, it follows that the second longitudinal structural part is arranged in the region of the inner side of the wheel arm. The second longitudinal structural part is, as defined above, a component of the lifting framework. If two wheel arms are provided, the second longitudinal structural part of the left wheel arm is, therefore, arranged on its right side, while the second longitudinal structural part of the right wheel arm is arranged on its left side.

It is particularly advantageous if the running wheel is arranged on the first longitudinal structural part. If the drive wheel and any other wheel present are mounted on the vehicle frame, and the running wheels are mounted on the first longitudinal structural parts of the wheel arms, the vehicle frame can stand on the ground and be moved independently. This makes it possible to mount equipment and superstructure on the vehicle frame in any location without special holding devices for the vehicle frame. It is moreover possible to transport and store the industrial truck, ready-assembled with the exception of the lifting framework, and to move it on its own wheels.

The first longitudinal structural part is advantageously made from sheet steel, preferably from a welded construction having at least two plates. The first longitudinal structural part is thus made of the same material as the vehicle frame.

The second longitudinal structural part is advantageously made from cast metal, preferably from cast steel or from ductile cast iron. The use of cast steel or ductile cast iron makes possible the complicated shaping necessary for connecting the lifting framework to the vehicle frame and the other parts of the wheel arm and also makes possible a welded connection to the lifting framework.

A screwed connection is provided for connecting the first longitudinal structural part to the second longitudinal structural part. Connecting the two longitudinal structural parts, and thus mounting the lifting framework on the vehicle frame as well, requires no complicated tools, in particular no welding tool. The lifting framework can, therefore, for example, be mounted on the vehicle frame after the industrial truck has been transported to its place of use.

An at least approximately vertical mast profile of the lifting framework is connected rigidly to the second longitudinal structural part of the wheel arm. In particular, a welded connection is suitable for this.

Particularly advantageous use can be made of the invention if the mast profile is arranged directly above the wheel arm. If, as is generally the case, the lifting framework has two masts and the industrial truck has two wheel arms, the non-raisable mast profiles are located directly above the wheel arms. The width of the lifting framework then corresponds approximately to the lateral distance of the two wheel arms.

As far as the method is concerned, the object described above can be achieved by the following exemplary method steps:

- the vehicle frame is preassembled with the first longitudinal structural part and with the running wheel of each wheel arm;
- the lifting framework is preassembled with the second longitudinal structural part of each wheel arm; and
- the two longitudinal structural parts of the wheel arm are interconnected when the lifting framework is mounted on the vehicle frame.

The preassembly of the vehicle frame with the first longitudinal structural part is affected by, for example, the vehicle frame and the longitudinal structural part having at least one common structural part. The running wheel is subsequently attached rotatably to the first longitudinal structural part. The preassembly of the lifting framework with the second longitudinal structural part is affected by, for example, welding the second longitudinal structural part together with a mast profile. Final assembly, during which the two longitudinal structural parts are interconnected and the lifting framework is at the same time attached to the vehicle frame, is affected exclusively by screwing the said together.

BRIEF DESCRIPTION OF THE DRAWINGS

Further advantages and details of the invention are explained in greater detail with reference to the illustrative embodiment shown in the diagrammatic figures, in which like reference numbers identify like parts throughout.

DESCRIPTION OF THE PREFERRED EMBODIMENTS

Figure 1:
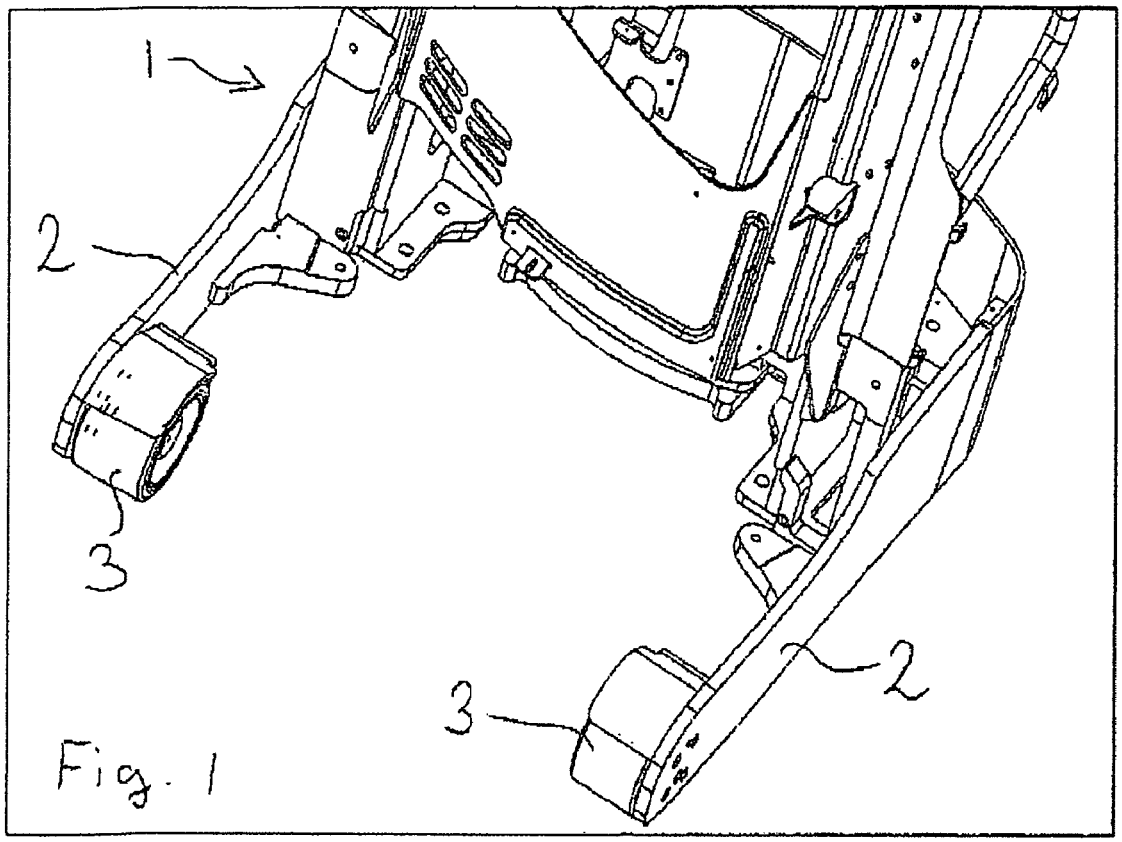
FIG. 1 shows a vehicle frame with the first longitudinal structural parts of the wheel arms.

FIG. 1 shows a vehicle frame 1 with the first longitudinal structural parts 2 of the wheel arms of an industrial truck according to the invention. In this illustrative embodiment, the industrial truck is a reach fork truck. The vehicle frame 1 has a plurality of sheet metal parts, which are welded together. The longitudinal structural parts 2 extend into the central region of the vehicle frame 1 and also constitute a supporting structural part of the vehicle frame 1. A running wheel 3 is in each case located in the region of the wheel arms 2 which is arranged at the front in the illustration.

Figure 2:
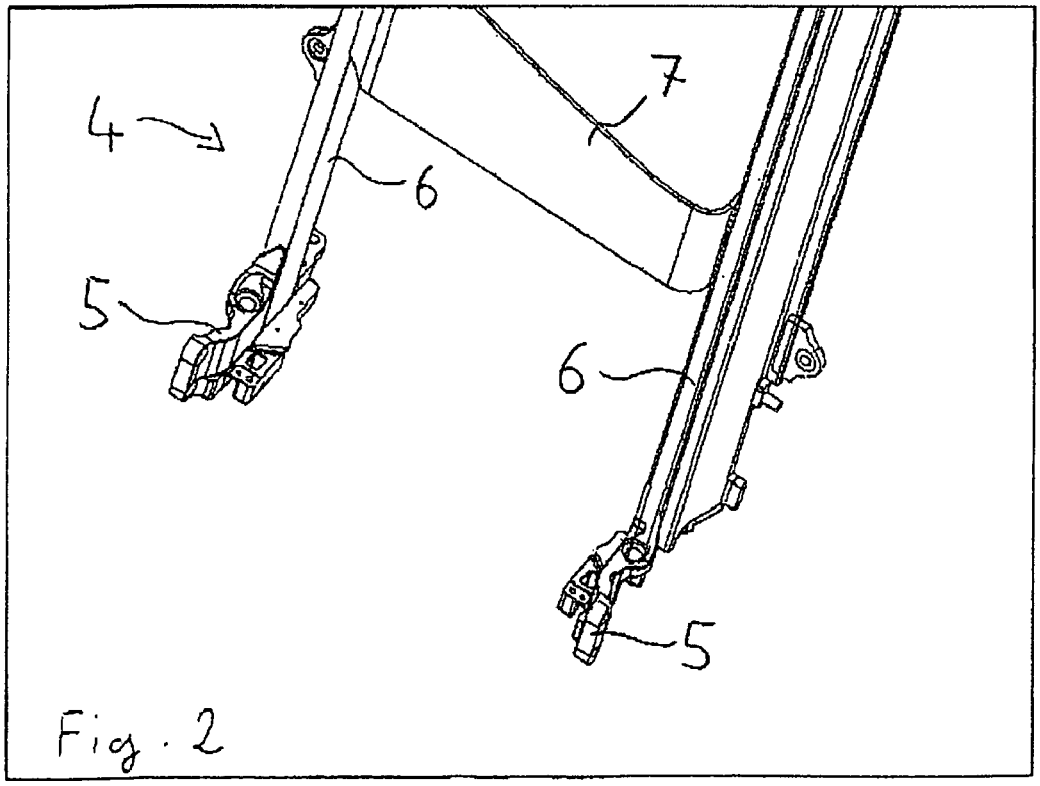
FIG. 2 shows a lifting framework with the second longitudinal structural parts of the wheel arms.

FIG. 2 illustrates a lifting framework 4 with the second longitudinal structural parts 5 of the wheel arms. Of the lifting framework 4, the two non-raisable mast profiles 6 are illustrated; these are interconnected by means of a transverse strut 7 and together form the non-raisable mast of the lifting framework 4. Located in the lower region in the drawing are the two second longitudinal structural parts 5 of the wheel arms, which are welded together with the mast profiles 6. The second longitudinal structural parts 5 are manufactured by casting.

When the preassembled unit according to FIG. 2 is attached to the preassembled unit according to FIG. 1, the wheel arms are completed at the same time as the lifting framework 4 is attached to the vehicle frame 1.

Figure 3:
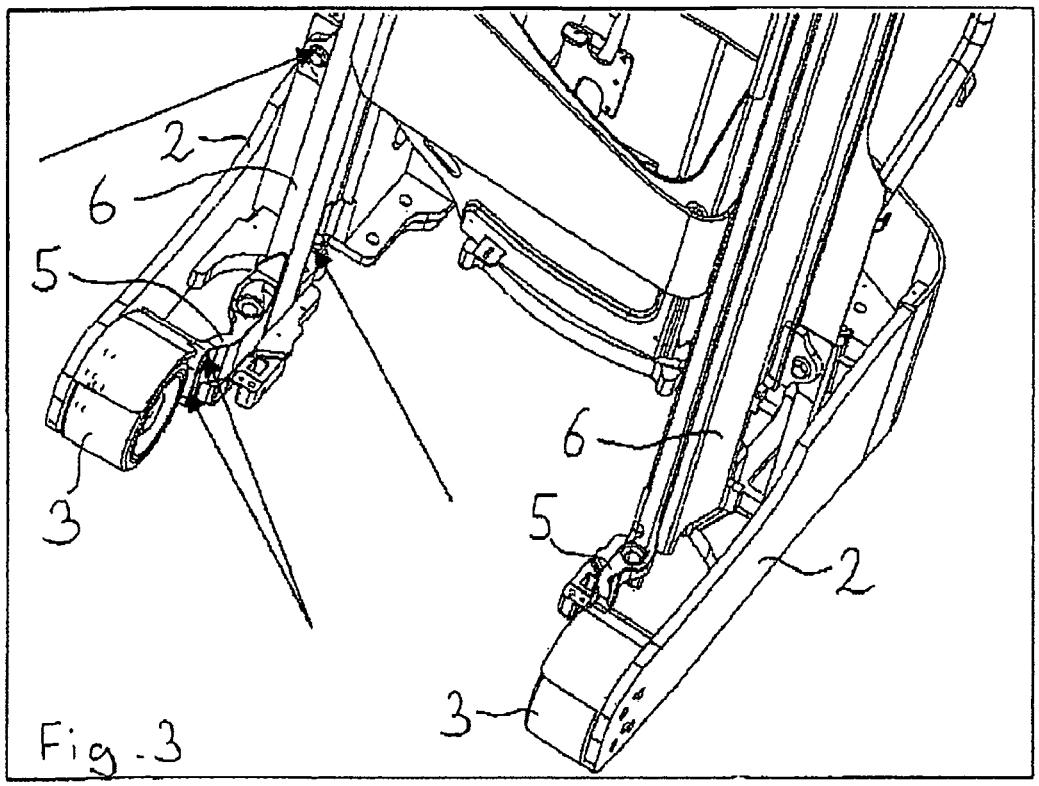
FIG. 3 shows a vehicle frame with mounted lifting framework and mounted wheel arms.

FIG. 3 shows the arrangement in the assembled state, the two preassembled units being screwed together with one another. On the left side in the drawing, the arrangement of the four screws provided for attachment is marked by arrows. On the right side in the drawing, a corresponding screwing arrangement is provided. During this assembly step, the first longitudinal structural parts 2 are connected rigidly to the second longitudinal structural parts 5, as a result of which the wheel arms are provided with the strength necessary for operation. At the same time, a connection is brought about between the lifting framework 4 and the vehicle frame 1, via which the forces acting on the lifting framework 4 during operation are transmitted to the vehicle frame 1.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

What is claimed is:

1. An industrial truck, comprising:

a preassembled vehicle frame unit including a pair of spaced first longitudinal structural parts as components thereof, each of the pair of spaced first longitudinal structural parts extending from a respective location on the vehicle frame, with each first longitudinal structural part having a running wheel on an outer end thereof; and a preassembled lifting framework unit attached to the vehicle frame unit and including a pair of spaced second longitudinal structural parts as components thereof, each of the pair of spaced second longitudinal structural parts extending from a respective location on the lifting framework unit, wherein the vehicle frame unit is fixedly and non-movably connected to the lifting framework unit such that each of the first longitudinal structural parts respectively rigidly connects to each of the second longitudinal structural parts, wherein spaced wheel arms of the industrial truck are formed by the first longitudinal structural parts and the second longitudinal parts respectively connected to each other, the spaced wheel arms having one of the running wheels at a free end of each arm, and wherein the second longitudinal structural part forms an inner side of the wheel arm.

2. The industrial truck according to claim 1, wherein the first longitudinal structural part forms an outer side of the wheel arm.

3. The industrial truck according to claim 1, wherein the second longitudinal structural part is made from cast metal.

4. The industrial truck according to claim 3, wherein the second longitudinal structural part is made from cast steel or from ductile cast iron.

5. The industrial truck according to claim 1, wherein the first longitudinal structural part is made from sheet steel.

6. The industrial truck according to claim 1, including a screwed connection for connecting the first longitudinal structural part to the second longitudinal structural part.

7. The industrial truck according to claim 1, including an at least approximately vertical mast profile of the lifting framework connected rigidly to the second longitudinal structural part.

8. The industrial truck according to claim 1, wherein each of the pair of first longitudinal structural parts extends from the vehicle frame unit at the respective location on the vehicle frame unit and each of the pair of second longitudinal structural parts extends from the lifting framework unit at the respective location on the lifting framework unit, and wherein the respective locations on the vehicle frame unit are separate from the respective locations on the lifting framework unit.

9. The industrial truck according to claim 1, wherein the first longitudinal structural parts extend from a central region of the vehicle frame unit.

10. The industrial truck according to claim 1, wherein the first longitudinal structural parts constitute supporting structural parts of the vehicle frame unit.

11. The industrial truck according to claim 1, wherein each of the pair of first longitudinal structural parts extends from the vehicle frame unit at the respective location on the vehicle frame unit in a forward direction of the industrial truck and each of the pair of second longitudinal structural parts extends from the lifting framework unit at the respective location on the lifting framework unit in the forward direction of the industrial truck.

* * * * *